United States Patent [19]

Cote et al.

[11] Patent Number: 4,706,641

[45] Date of Patent: Nov. 17, 1987

[54] AUTOMATIC CLAY TARGET FEEDER ATTACHMENT FOR TRAP SHOOTING MACHINES

[76] Inventors: Roger J. Cote; Ronald P. Cote, both of R #7 Box 540, Augusta, Me. 04330

[21] Appl. No.: 855,270

[22] Filed: Apr. 24, 1986

[51] Int. Cl.[4] ..... F41B 3/04

[52] U.S. Cl. ..... 124/8; 124/32; 124/34; 124/47; 124/50

[58] Field of Search ..... 124/8, 7, 9, 32, 34, 124/47, 50

[56] References Cited

U.S. PATENT DOCUMENTS

| | | | |
|---|---|---|---|
| 2,171,623 | 9/1939 | Connell | 124/32 X |
| 2,652,820 | 9/1953 | Darrel | 124/47 X |
| 2,711,726 | 6/1955 | Darrel | 124/47 X |
| 2,996,058 | 8/1961 | Erxine | 124/47 X |
| 3,088,452 | 5/1963 | Foster | 124/47 X |
| 3,119,383 | 1/1964 | Foster | 124/9 |
| 3,304,928 | 2/1967 | Darrell | 124/47 |
| 3,621,828 | 11/1971 | Hansen | 124/8 |
| 3,677,257 | 7/1972 | Segerkvist | 124/47 |
| 3,841,293 | 10/1974 | Laporte et al. | 124/8 |
| 3,923,033 | 12/1975 | Laporte et al. | 124/8 |
| 3,937,203 | 2/1976 | Riedmueller et al. | 124/8 |
| 4,146,007 | 3/1979 | Alday et al. | 124/9 |

*Primary Examiner*—Richard J. Scanlan, Jr.
*Assistant Examiner*—Todd Williams
*Attorney, Agent, or Firm*—Laforest S. Saulsbury

[57] ABSTRACT

An automatic clay target feeder attachment that can be attached to a clay target trap shooting machine that will self-load the trap shooting machine without need of manual assistance within the forward trap pit on the shooting range. Such feeder attachment can be selectively set to drop onto the flinger arm of the trap shooting machine either two targets or but one target at a time including means that will move the dropped targets outwardly along the flinger arm preparatory to the release of the flinger arm by the shooter's referee upon the shoot being made by the trap shooters. The operation of the attachment to load the flinger arm with targets is done in response to actuation of the trap machine and the release of its flinger arm.

3 Claims, 9 Drawing Figures

AUTOMATIC CLAY TARGET FEEDER ATTACHMENT FOR TRAP SHOOTING MACHINES

This invention relates to a trap shooting machine and more particularly to an automatic clay target feeder therefor adapted to selectively feed either one or two clay targets to the trap shooting machine for the purpose of being flung into the target area to be fired upon by the trap shooter.

BACKGROUND OF THE INVENTION

Trap shooting machines in the shooting area are normally hand loaded with targets by a boy in the trap arm pit well protected and located some twenty-five feet in advance of the trap shooters. Upon the flinger arm of the trap machine being loaded, the referee calls fire and by a switch in his hand triggers the trap machine to fling the targets into the target area for the shooter to hit and blow apart. The difficulty today is to find boys eagerly available and at a reasonable wage to man the pits and hand load these trap shooting machines. The job of this boy is to merely remain in the trap arm pit and physically place one or two targets upon the trap machine flinger arm preparatory to the triggering of the trap machine by the referee for the next shooting.

These trap shooting machines include a flinger arm and a tension spring that is stressed by electric motor-operated mechanism and released to effect sudden and forceful rotation of the loaded flinger arm to heave or fling the targets into the forward target area. The Winchester-Western trap shooting machine is the one machine most commonly found in skeet shooting areas and will throw or fling clay targets of regular trap quality to a height of some eight to fifteen feet at ten yards from the trap arm pit and that fall some fifty yards therefrom. The trap machine may be adjusted to different vertical variations so that the targets may reach various heights.

The clay targets are composed of asphalt pitch and ground lime and are strong enough to be heaved out by the machine at high rates of speed and yet fragile enough to break when hit by the shooter's No. 9 pellets at thirty or forty yards from the shooter. These targets are domed and of inverted dish shape and can be stacked one within the other. They have a diameter of $4\frac{1}{4}$ inches, total height of 1 1/16 inches and weigh $3\frac{1}{2}$ ounces.

Automatic clay target feeders for trap machines have been provided to replace the boy in the trap pit and have been available in the form of a single dispenser of the clay targets onto the flinger arm but no automatic loader has heretofore been provided for automatically dispensing and locating two clay targets upon the flinger arm preparatory to the shooting and in an arrangement that can selectively by a throw of a switch have either two targets placed upon the flinger arm of the trap machine or but one target placed thereon.

SUMMARY OF THE INVENTION

With the present invention, there has been provided such a selective one or two target feeder in the form of an attachment for use with trap machines of the Winchester-Western type to convert this normally manually-loaded trap machine into an automatic self-loading trap machine to selectively fling either single or double targets into space. Nor has there been provided a feeder for clay target which includes means for positioning the targets outwardly along the flinger arm after they have been dropped thereon. For two targets, room has to be made for placing of a second target onto the flinger arm and to move the first target dropped against a stop and to provide room the second target.

OBJECTS OF THE INVENTION

The principal object of the present invention is to provide a clay target feeder for trap shooting machines that will automatically load and locate two targets upon the flinger arm of the trap shooting machine to be flung in a spreading fashion into the target space area.

It is another object of the invention to provide a clay target feeder attachment for trap shooting machines that can be selectively set to either drop one or two targets upon the flinger arm of the trap shooting machine that will be carried on the top housing of the machine to be adjustable therewith when adjusting the inclination of the flinger arm to the desired height and range either singly, or doubly in a spreading manner.

It is another object of the invention to provide a target feeder attachment for trap shooting machines in which the trap machine flinger arm may be set to be loaded with two clay targets to be flung into the air to be shot down by double-barrelled shooting guns but which can be changed by a flip of a switch to shoot but a single target by a single-barrelled shotgun.

It is another object of the invention to provide a clay target feeder attachment for trap shooting machines for feeding clay targets, in which, the selection of either a single target or two targets can be simply effected by the flipping of an electric switch that includes adjustable time-delay relay elements and switch means operable by the flinger arm when registered beneath the feeder for effecting the dropping of the target upon the flinger arm and the movement of the target therealong.

It is still another object of the invention to provide a clay target feeder attachment for trap shooting machines that is adapted to drop and move clay targets along the flinger arm of the trap shooting machine in which operable time delay components can be readily adjusted within electric circuitry to place the target handling devices in timed relationship with one another to drop the target upon the extended flinger arm and move it theralong in time relationsip with a trip switch operable by the return of the flinger arm of the trap shooting machine upon its being released at the time for the shooting.

It is a further object of the invention to provide a clay target feeder attachment for trap shooting machines, which, in the use of the same, guide and stop means for aligning and limiting the movement of the targets along the flinger arm are provided that are spring biased toward their work positions and yet releasable for the flinger arm to ride over when released for the flinging of the targets.

Still further objects of the invention are to provide a clay target feeder attachment for trap shooting machines, with all of the above objects in mind, in which, the attachment is of simple construction, has a minimum number of parts, easy to assemble and install upon a trap shooting machine, easy to control and adjust for timed sequence of its operable devices, and automatic, effective and efficient in operation.

BRIEF DESCRIPTION OF THE DRAWING

For a better understanding of the invention, reference may be had to the following detailed description taken in connection with the accompanying drawing, in which.

DETAILED DESCRIPTION OF THE INVENTION

Figure 1:
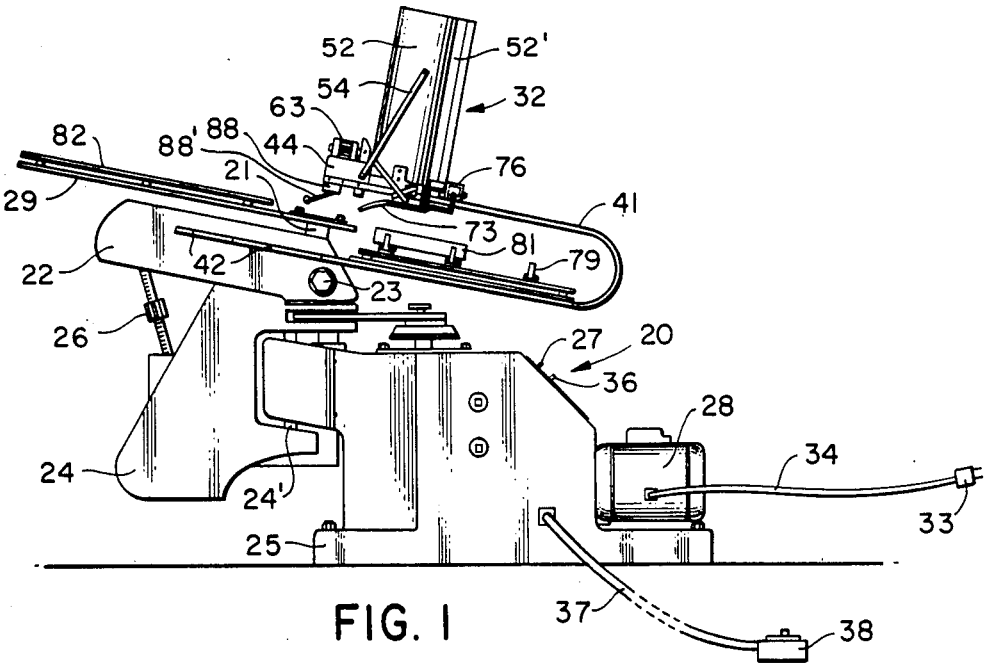
FIG. 1 is an elevational view of a standard trap shooting machine with the automatic clay target feeder attachment embodying the features of the present invention attached thereto, the target flinger arm of the machine normally lying thereunder but shown here as extended to allow for a more full view of the attachment.

Referring now to the Figures, 20 represents generally a standard trap shooting machine of the Winchester-Western tye that heaves or flings hand-loaded clay targets from its location in a trap pit lying in advance of the trap shooter and placed upon the flinger arm by a boy in the trap pit well protected from the shooter shots that pass thereover. The trap shooting machine 20 has an internal operating spring that is preloaded to release for rotation a vertically-extending rotatable shaft 21 projecting upwardly from an adjustable top forward-extending housing part 22. This housing part 22 is pivoted for vertical inclination adjustment on a transverse pivot 23 to set the elevation and range for the flinging of a clay target and in turn is carried by a laterally-shiftable housing part 24 about a vertical pivot 24' upon fixed base housing part 25. The elevation of the forwardly-extending housing part 22 is changed by a vertically-adjustable mechanism 26 and its lateral movement is prompted by operating electric switch 27 on the rear of the base housing part 25. A main drive motor 28 operates gear mechanisms that extend through the base housing part 25, the laterally-shiftable housing 24, and adjustable forwardly-extending housing part 22 to set the rotatable shaft 21 to load the operating spring within the machine, preparatory to its release to cause the sudden rotation of a flinger arm 29 through its instantaneous forward advance point to effect the forward heaving or flinging of clay targets 31, FIG. 2, that will have been selectively fed to the flinger arm 29 either singly or doubly prior to its release. The clay targets 31 will have been dropped singly, or doubly one after the other. When two targets are to be dropped upon the flinger arm 29 the first target is moved therealong to leave room for the dropping of a second target.

After the flinger arm 29 has been released, it is returned to its normal position beneath feeder attachment 32 and is automatically loaded again by the feeder attachment without the need of a pit boy or one in the trap pit. The main drive motor 28 is supplied from an electrical source at the pit by a plug 33 and a cable 34 as a main switch 36 adjacent the switch 27 on rear of the base housing part 25 is turned on. The release of the flinger arm 29 is controlled through an elongated switch cable 37 that extends to the referee's station in rear of the shooters for his depression of the cable button switch 38 thereon. Upon the referee's command to fire, he depresses the switch button 38 to release flinger arm 29 and the clay targets 31. Shots are then made over the trap pit at the clay targets that will have been heaved into space in advance of the pit to an elevation of some fifteen feet in the manner illustrated in FIG. 7. The shooter will be firing at either one or two of the targets at each shooting, but with a double barrel shotgun for the two heaved targets.

The automatic target feeder attachment 32 includes an attaching frame structure 41 that is adapted to be fitted astraddle the tiltable top housing part 22 and comprises two U-shaped attaching pieces 41' and 41'' with elongated lower legs running respectively along the respective sides of the top housing part 22 and attached thereto by screws 42. These U-shaped pieces 41' and 41'' are held spaced from one another by a bottom tie sheet 43, FIGS. 3 and 6, secured between the lower legs of the pieces rearwardly removed from their connection with the housing part 22. It is the lower legs of the pieces that extend forwardly onto the forward housing part 22. The upper legs of these U-shaped frame pieces are spaced above the flinger arm to permit the passage of the flinger arm 29 with the targets 31 thereunder to fling the targets and alow the flinger arm 29 to be returned to its normal loading position. The upper legs of the U-shaped attaching frame pieces 41' and 41'' are tied together at their forward ends by a raised platform 44 having depending sides respectively fastened to their corresponding attaching pieces by screws 45, FIGS. 2 and 3, rearwardly thereof by a diagonally running tie sheet 46 secured between the U-shaped attaching pieces 41' and 41'' by screws 47. Further means may be used for the securement of the attaching U-shaped leg frame 41 to the vertically-adjustable housing part 22 so that there can be no play whatsoever therebetween and so that the entire feeder attachment 32 will be solidly vertically and laterally moved with the housing part 22 as this housing port is vertically and laterally adjusted relative to the other housing parts 24 and 25 of the trap shooting machine 20.

Figure 3:
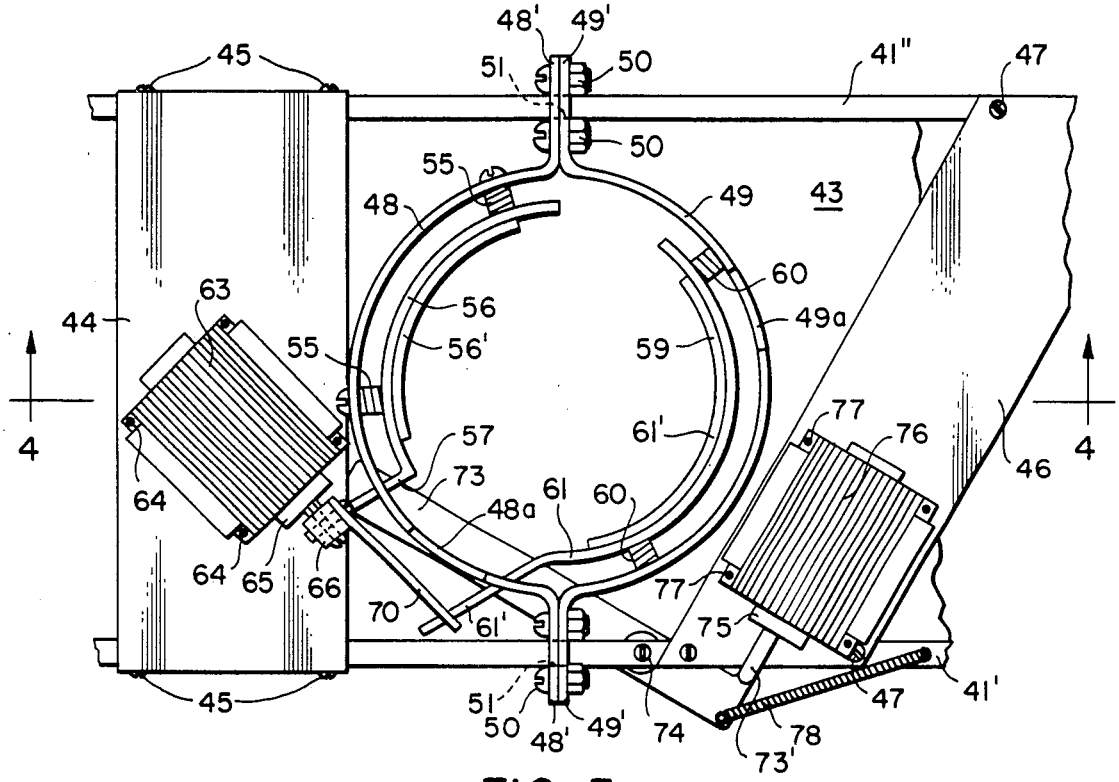
FIG. 3 is an enlarged fragmentary top plan view of the target feeder attachment taken generally on line 3—3 of FIG. 2, the target containing column having lifted therefrom.

As best seen in FIG. 3, two opposing half-cylindrical ring parts 48 and 49 are joined together intermediate the feeder by their extensions 48' and 49' fastened together by screw bolts 50 that overlie the upper legs of the U-shaped attaching pieces 41' and 41'' to be supported thereby. The bottom edges of the joined ring extensions 48' and 49' are notched as indicated at 51 in their underedge to fit tightly down over the upper legs of the U-shaped attaching pieces and yet releasable to be adjustable along the attaching pieces when needed for the proper drop positioning of the targets 31 upon the flinger arm 29 at best distances from its rotatable shaft 21.

These assembled ring parts 48 and 49 serve as a base for a vertically-slotted, target-containing column 52 with a vertically-extending opening 52' for access to the stacked targets 31 that will have been dropped into the column 52 through its top and upon such operable parts that support the targets within the column. These left and right ring parts 48 and 49 respectively have upstanding projections **48*a* and 49*a* within which the target-containing column 52 fits and is secured by bolt assemblies 53 thereto to provide a combined unit of the column 52 and the ring parts 48 and 49. While the ring parts are tightly fitted through their notches 51 to the attaching pieces 41' and 41'' and in order to prevent fore and aft tilting of the combined column and ring parts, braces 54 are provided respectively at front and rear sides thereof, only one being shown, and secured between the forward platform 44 and the upper part of the column 52**.

While the stacked clay targets 31 can fall freely within the column 52 under gravity, a release mechanism is provided that supports the stacked targets while permitting for the single release and dropping of but one target at a time upon the flinger arm 29 preparatory to the target being flung into space to be shot down by the shooter. Such release mechanism for dropping a target upon the flinger arm will now be described.

Figure 4:
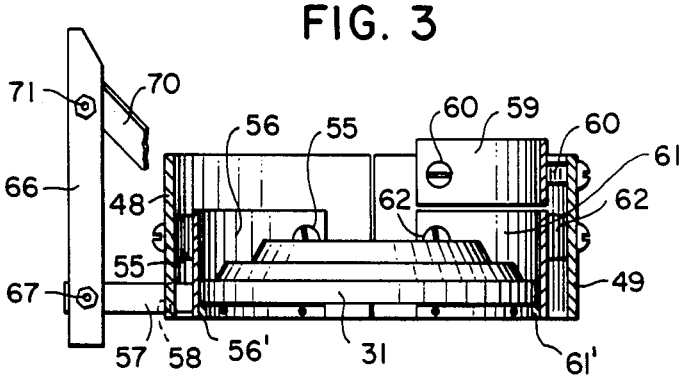
FIG. 4 is a fragmentary vertical sectional view of the target feeder attachment taken generally on line 4—4 of FIG. 3 and looking into the bottom of the feeder with the target therein and its guide and releasable stop members for supporting the clay targets by their edges before being dropped upon the flinger arm.
Figure 5:
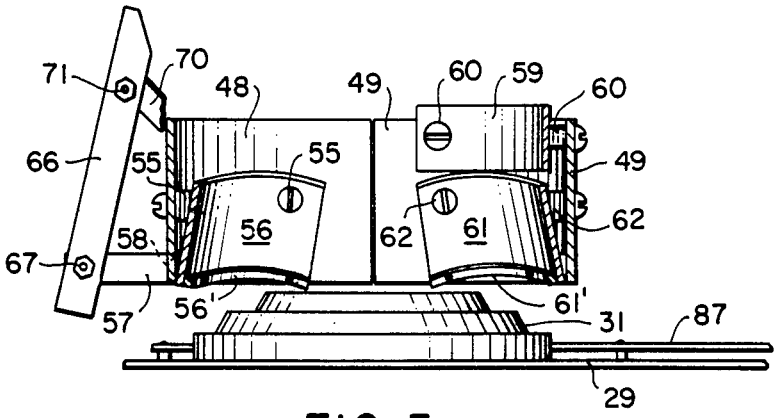
FIG. 5 is a similar fragmentary vertical sectional view of the attachment with the feeder guide and stop members having been instantly expanded to have dropped the target upon the flinger arm as shown thereunder.

On the left half-ring part 48, there is inwardly and biasingly mounted by loose compression spring and screw assemblies 55, a semi-circular shaped releasable bottom stop member 56 that conforms in contour to the rounded edge of the clay targets 31, FIG. 3. This stop member 56 has an inwardly-extending bottom lip projection 56' secured thereto that normally underlies the bottom edge of the lowermost target 31 as viewed in FIG. 4 but with targets stacked above it. To release the bottom target 31 from the stop member 56, the stop member 56 is rocked and its lip projection 56' withdrawn from the lower edge of the bottom target 31, as illustrated in FIG. 5. This stop member 56 is so placed that on release of the target as to place its upper edge in the downward path, of the stacked targets thereabove to hold the stack in place with the aid of an opposing guide and stop members 59 and 61 while dropping the bottom target from the stacked targets onto the flinger arm 29. A rigid arm 57 is fixed to the lower part of the stop number 56 and extends rigidly outwardly through an enlarged hole 58 in the sleeve part 48 and is worked in this hole 58 against the action of the biasing spring assemblies 55 to release the target 31.

To fully support the stacked target, this bottom stop member 56 works in cooperation with the raised opposing spring-biased guide and stop members 59 and 61 held within the right sleeve part 49 by loose compression spring and screw assemblies 60 and 62 that position, frictionally restrain and work in coopration with the opposing controlled arcuate stop member 56 to guide the fall of the stacked targets on lowermost target 31 being released from the stop members 59 and 61.

The right opposing releasable stop member 61 corresponding to the stop member 56 at the left side, lies below the stack guide member 59 and has a lip projection 61' secured thereto is similarly supported on the ring part 49 by biasing spring and bolt assemblies 62 and such that its lip projection 61' can be released from underneath the opposite edge of the target 31 simultaneously with the release of the left edge of the target by the left stop member 56 from its bottom lip 56'. With the targets carried on the lip projections 56' and 61' of the releasable left and right stop members 56 and 61, the lipped stop member 61 normally lies in vertical alignment with the top right guide member 59, (see FIG. 4).

Common electro-magnet means 63 for the simultaneously rocking of the stop members 56 and 61 in unison to release the target 31 onto the flinger arm 29 in manner illustrated in FIG. 5 will now be described. This electromagnet 63 is secured in an inclined manner on the raised platform 44 by screws 64 so that its plunger 65 will engage the upper end of a vertically-extending upstanding pivot arm 66 rigidly fixed to the rigid arm 57 of stop member 56 by a bolt assembly 67 so that as the arm 57 is turned and worked in the opening 58 in sleeve part 48 agaisnt the action of loose compression spring and bolt assemblies 55 that support the stop member 56 upon the sleeve part 48, the lip projection 56' of the stop member 56 is thus withdrawn from under the edge of the lowermost target 31 to release the target 31 and drop it on flinger arm 29 as the free plunger 65 is extended by the electro-magnet 63 upon being energized to push against the upper end of the vertically-extended pivot arm 66 against the action of the loose stop member springs and bolt assemblies 55 of the stop member 56. At the right side of the target 31 is the opposing stop member 61 which is simultaneously and similarly worked by a link 70 against the action of its comprssion spring and slide bolt assemblies 62 to release the lowermost target simultaneously with the release of the same target by stop member 56.

Figure 2:
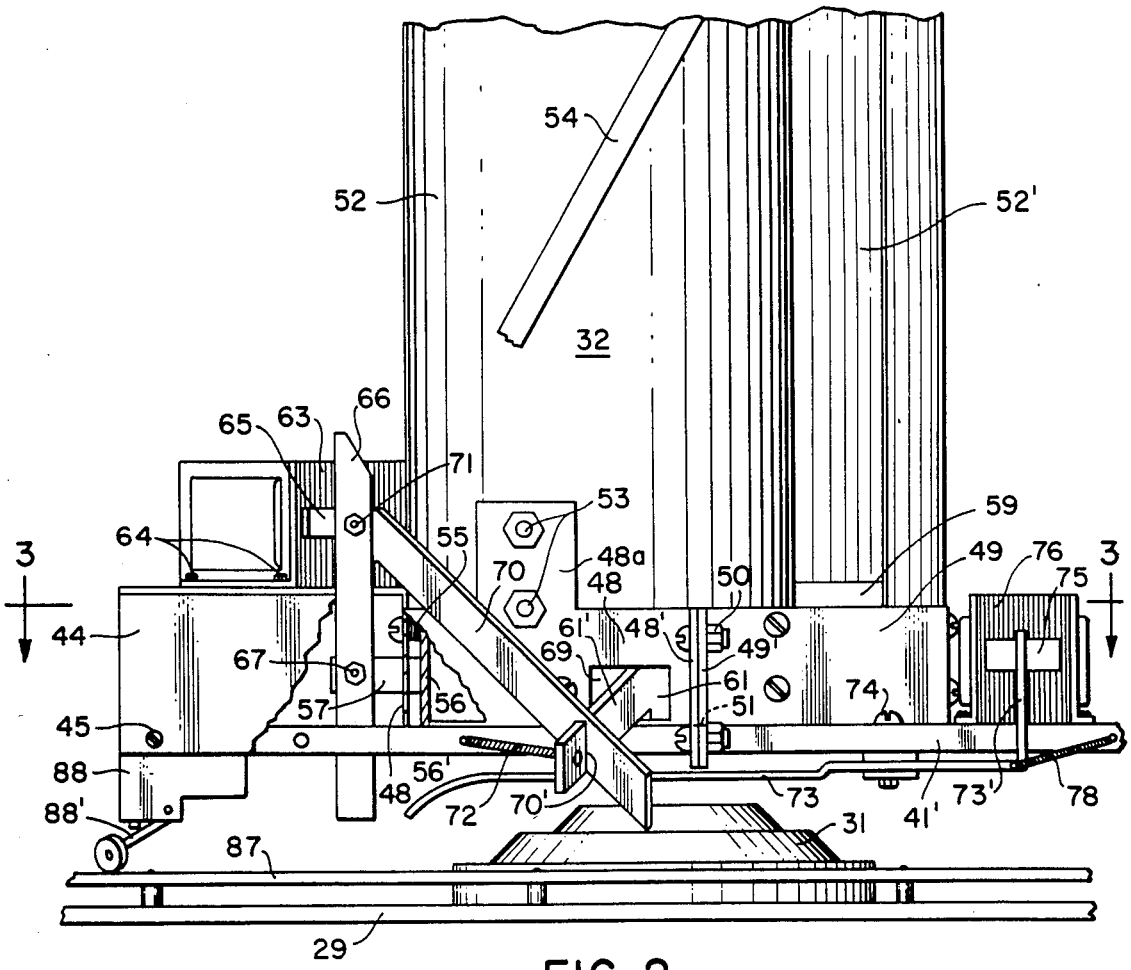
FIG. 2 is an enlarged fragmentary elevational view of the target feeder attachment with one target having been just dropped upon the flinger arm as shown lying therebelow.

This right releasable stop member 61 has an extension 61' that extends forwardly through an opening 69 in the left ring part 48, FIGS. 2 and 3, and is connected by a link 70 that is notched at 70' to lie over the top edge of the stop extension 61'', for connection thereto. This link 70 is inclined upwardly for connection with the upper end of the vertically-extending pivot arm 66 by a bolt assembly 71. As the free plunger 65 of electromagnet 63 strikes the vertical pivot arm 66 both target stop members 56 and 61 are rocked and spread to release the target 31 from their respective lip edges 56' and 61', FIG. 5. A tension return spring 72 is connected between the free end stop member extension 61' and the attaching frame piece 41' to normally keep the vertical arm 66 closed upon the plunger 65 of the electromagnet 63 and the plunger 65 retracted.

The lowermost target 31 when released is dropped onto the top surface of the flinger arm 29 preparatory to the release of the flinger arm 29 to heave or fling the target into space to be fired upon by the trap shooter. To mechanically effect a moving of the dropped target 31 along the flinger arm 29, an elongated pusher arm 73 is pivotally connected by pivot bolt assembly 74 to the underside of the upper leg of the attaching frame piece 41' FIGS. 3 and 6. This pusher arm 73 extends forwardly to engage the dropped target 31, and when pivoted in a horizontal manner, engages the target 31 and pushes the target rearwardly along the flinger arm 29 to clear the flinger arm surface for the dropping of a second target as when it is desired to fling two targets into space for a double shooting by the trap shooter. For the operation of the target pusher arm 73, this arm 73 is bent up at 73' and extends laterally for engagement with a free plunger 75 of an electromagnet 76 secured by screw bolts 77 to the inclined tie sheet 46 that strikes at the turned-up end 73' of the pivot pusher arm 73 to move the target 31 along the flinger arm. The pusher arm 73 and plunger 75 are returned to their normal retracted positions by a tension spring 78 connected between the arm 73 and attaching frame piece 41'. Thereafter, a second clay target 31 is dropped onto the flinger arm 29 and may be left in place or moved against first target already in place far outwardly of its rotatable shaft 21 and they will be flung at high speed by the flinger arm being released. Both electromagnets 63 and 76 are included in the electric circuitry to be later described.

Figure 6:
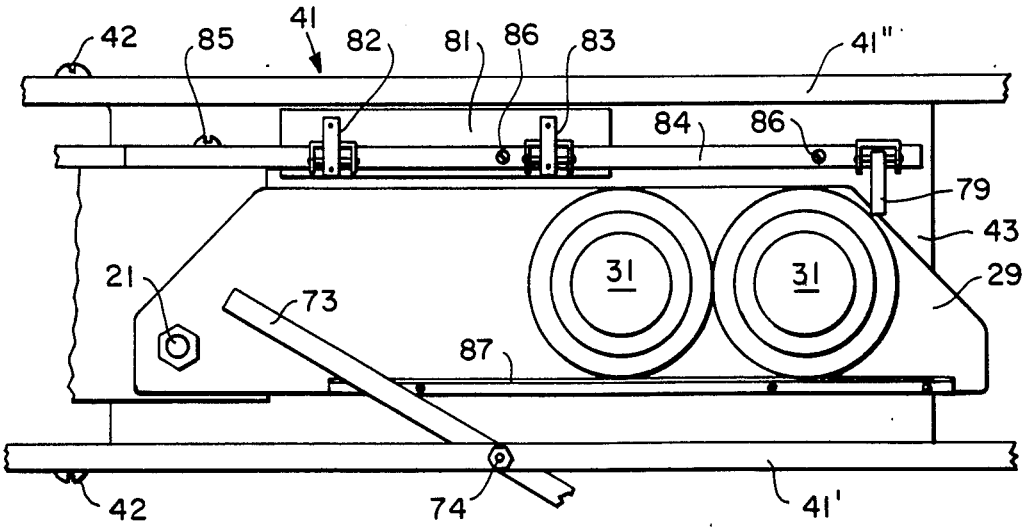
FIG. 6 is a fragmentary top plan view looking upon the bottom of the feeder attachment and upon flinger arm with two clay targets having been dropped thereon and moved outwardly therealong by the pusher arm means pass spring-biased target guide and against the spring-biased stop post to confine the targets and limit their movement along the flinger arm while being loaded.

The first of two targets 31 will have been moved along the flinger arm 29 by the pusher arm 73 until it has closed upon a releasable spring-biased stop 79, FIG. 6, projected upwardly into the path of the target by its spring that flexes so that the target 31 will pass over it on the flinger arm 29 upon being released. Following the positioning of the first target upon the flinger arm, there will be dropped a second target 31 onto the flinger arm 29 and may be moved in a like manner by the pusher arm into engagement with the first dropped target 31 so that the two targets will have been moved upon the flinger arm 29 preparatory to their release and the firing of the trap shooters. The second target may more often be left on the flinger arm 29 in its dropped position without being moved.

In order that the target 31 after being dropped onto the flinger arm 29 will be guided when being moved by the pusher arm 73, an upwardly and rearwardly extending transparent guide plate 81 is secured between two spring stop arm assemblies 82 and 83 similarly to the spring stop arm assembly 79, FIG. 6. These spring stop arm assemblies 79, 82 and 83 are adjustably retained upon an elongated support bar 84 vertically spaced and supported upon the bottom tie sheet 43 spanning the lower legs of the U-shaped attaching pieces 41' and 41''. The forward end of this elongated support bar 84 is rigidly connected by screws 85 to the side of the forwardly-extending housing part 22 and movable therewith as is the target feeder attachment 32, also rigidly connected thereto. By screws 86 rigidly connecting the support bar 86 to the bottom tie sheet 43 gives further rigidity for the attaching of the target feeder 32 rearwardly of the top housing 22 so it thus carries the full feeder attachment and its posts.

Figure 7:
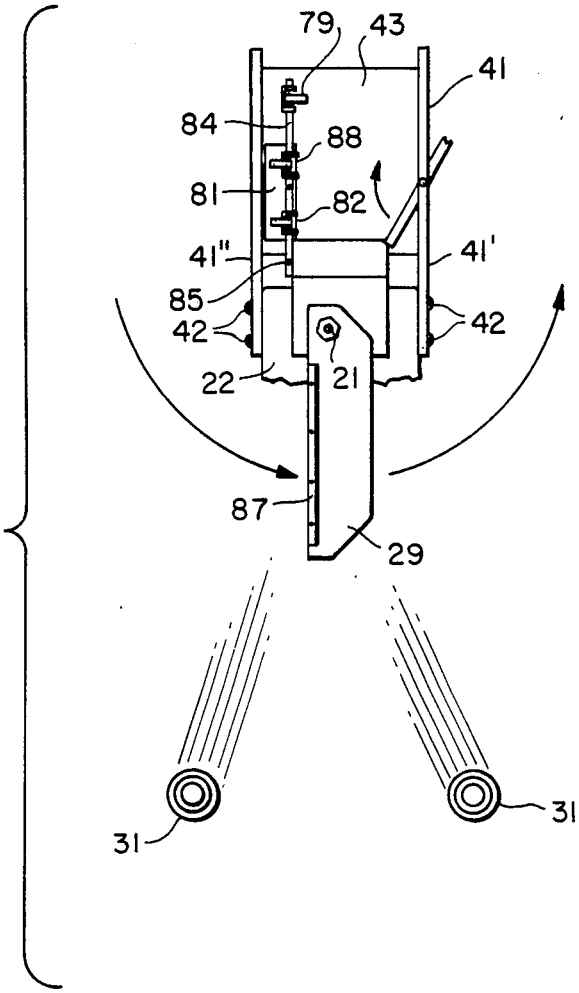
FIG. 7 is a collective reduced size top plan view similar to FIG. 6 and illustrating the releasing of the flinger arm and with the targets having been flung into space.

With the targets 31 being in place as viewed in FIG. 6, and upon the flinger arm 29 being released to fling the targets 31 into space forwardly of the trap machine 20 as illustrated in FIG. 7, the spring-biased stop arm assemblies 79, 82 and 83 will flex rearwardly, as viewed in FIGS. 6 and 7, so that the flinger arm will rise rearwardly over these stop arm assemblies upon being released to fling the target 31. It should be further noted that these stop and guide plate assemblies and support bar 84 are supported on the bottom tie sheet 43 so as to lie rearwardly and in front of the leading edge of the flinger arm 29 and independently thereof.

The flinger arm 29 has a raised elongated guide bar 87, that is fixed thereto along its top surface to confine the targets therealong as they are being positoned by the pusher arm 72 and to strike the targets on release of the flinger arms and effect their thrust into space. The guide bar 87 is raised just sufficiently to engage the target on its largest and bottom diameter and is a standard part of the trap shooting machine 20 and its flinger arm 29. The operation of the flinger arm is always instigated by the referee at his firing post by his pressing the button switch 38 extending by cable 37 from the trap machine as seen in FIG. 1.

The selective control system for causing either the delivery of two targets to the flinger arm 29 or but one target will now be described. The devices for mechanically dropping and moving the targets has been described so that this description will now be directed to the adjustable time-delay relay control system that is put in operation when trip switch 88 depending from the top housing part 22 is triggered by the flinger arm 29 as it is released and rotated thereunder. After the triggering of switch 88, all mechanical operations are carried out automatically in consecutive order for either the two targets or but one. The release of the flinger arm 29 by depressing hand switch 38 and the triggering of the depending trip switch 88 by the flinger arm 29, starts a new loading cycle of either two targets or the one target upon the flinger arm 29.

The flinger arm 29, upon which the targets rest, on release moves at a considerable rate of speed and the guide bar 87 of the flinger arm 29 hits the roller arm 88' of switch 88 for a split second but that is long enough for a time delay relay 91 to be activated. However, this time delay relay 91 provides its own holding circuit to keep the voltage present as it times out. This relay 91 has two sets of contacts, **91*a* and 91*b*, one of which activates the holding circuit, the other set activates relays 93 and 94. When the voltage is applied to the relays 93 and 94 and the set time has expired, their contacts will be closed. Relay 94 is time set for a longer time than relay 93 for the attachment to function properly because the relay 93 controls the electromagnet 94 that drops the targets and relay 94 controls the electromagnet 76 that activates the target pusher arm 73 that moves the dropped targets along the flinger arm 29. A target is first dropped before it pushed away by pusher arm 73**.

After relays 93 and 94 have timed out, relay 91 no longer is needed to allow voltage to be applied to these relays 93 and 94. Relay 91 will hve been energized for a time greater than relays 93 and 94 and this is because relay 91 controls these relays 93 and 94. If the attachment was in the single mode of down for switch 101, the above procedure will have taken place and the attachment will have been set for the dropping of but another one target for the next time the flinger arm 29 comes round.

Figure 8:
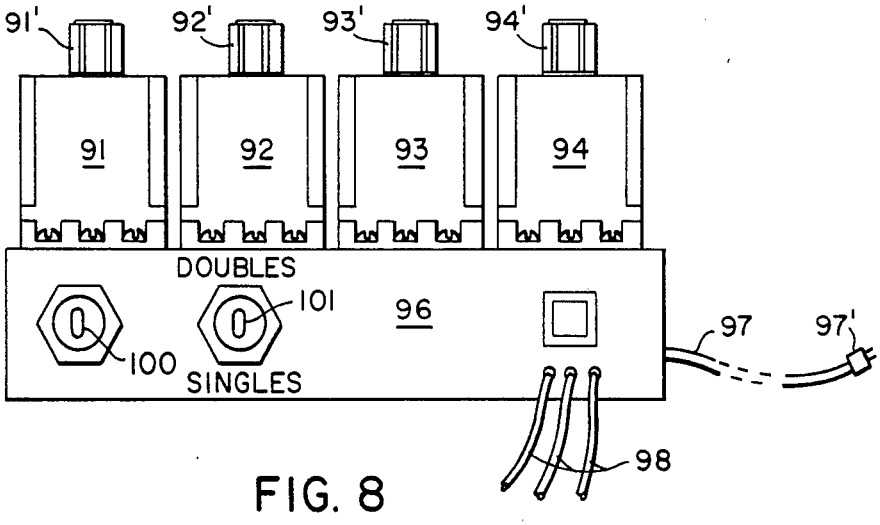
FIG. 8 is an elevational view of four adjustable time-delay relays assembled together upon a base having main and selective control switch buttons.
Figure 9:
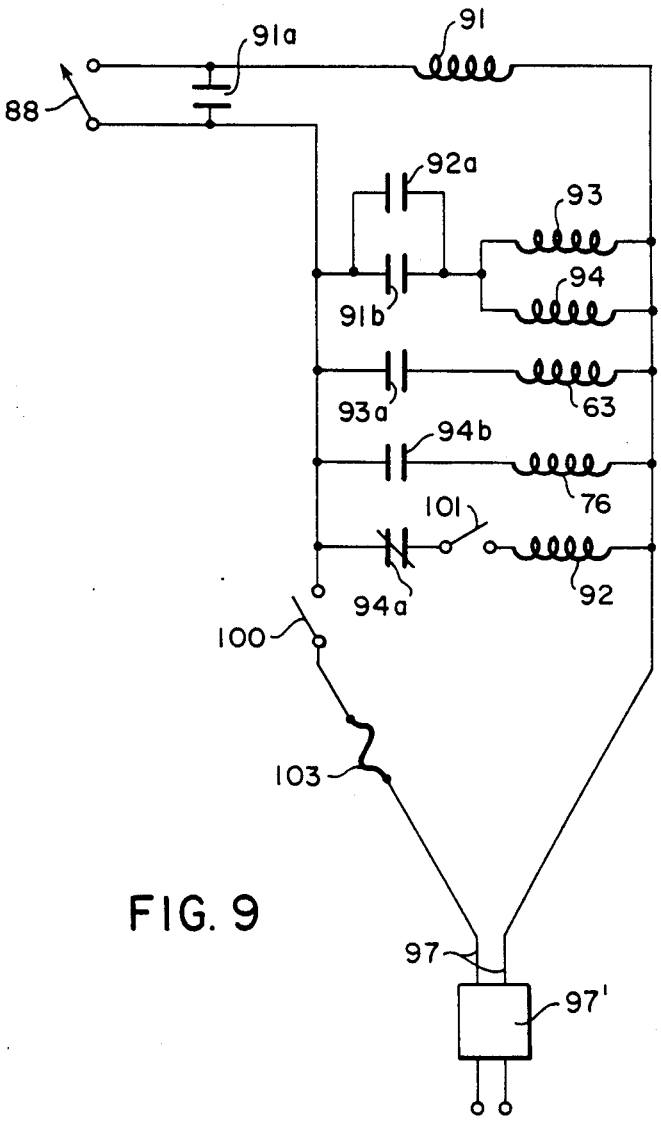
FIG. 9 is a wiring degree diagram of the adjustable and selective time-delay relay system circuitry causing the clay targets to be singly or doubly dropped and moved upon the flinger arm of the trap machine.

Referring now particularly to FIGS. 8 and 9 a series of adjustable time delay relays 91, 92, 93 and 94, having respectively adjustable timing knobs 91', 92', 93', and 94', are mounted on a box-type base 96 from which cable 97 with its wall plug 97' extends for connection into an electric wall receptacle source and other cable 98 to connect the circuitry of the time delay relay with the electromagnets 63 and 76 that effect the dropping and moving of targets 31 upon the flinger arm 29. With a relay switch 100 on the front of the base 96 turned on the relay circuitry is put under the control of the flinger arm trip switch 88. A selector two-way switch 101 is also provided on the base 96 to select for the flinging of two targets or but one. The electric plug 97' when inserted in an electric wall receptacle receives and supplies electric current to the circuitry of this control system. The circuitry includes a fuse 103 in line with the turn on switch 100. The circuitry is such that the targets be dropped one at a time and if the switch will have been turned to the double position two targets will have been dropped before the loading is completed. The target feeder then is standing by and nothing happens until the flinger arm 29 is released upon hand switch 38 being depressed by the referee to fling the target or targets from the trap machine and the roller arm 88' of switch 88 depending from the forward end of the feeder attachment 32 has been triggered by flinger arm 29, see FIGS. 1 and 2.

This trigger trip switch 88 first causes relay 91 to be activated. The voltage in this relay 91 closes contacts 91a and when the time set by its respective adjusting knob has expired, it opens its contacts 91a. Voltage has to be present when this relay is timing out and can be present after it has timed out, but the voltage must first be removed before the target feeder can again be activated.

With the switch 101 flipped up, the time delay relays will be placed in the doubles mode. Upon the flipping of the switch 101 from singles to doubles, the first target is dropped, and the relays 93 and 94 activated in the above manner. But with doubles, relay 92 like relay 91 has its contacts 92a closed when the voltage is applied and stay closed until the time set for the relay 92 has expired. This happens regardless of whether or not the voltage is still applied after it times out. When the second target is dropped, it is because relay 92 has been activated and relay 92 having taken over for again activating relay 92 and relays 93 and 94. If there is little need, the second target relay 92 will not activate relay 94 because the time set on relay 92 will have expired before relay 94 had a chance to be again activated. Relay 92 works just like relay 91 except that the time has been set for a shorter duration. If the adjustment for the movement of the second target is also desired, the relay 92 will be set for a longer duration to overun relay 94.

Relay 92 for the double mode will have been turned on by relay 94 since when relay 94 has not been activated, it has a normally-closed set of contacts to supply relay 92 from the moment that the attachment is turned on unless it is in the singles mode. If it is in the singles mde, there is a switch 94*a* between the relay 101 and the relay 92. If this switch is opened, it is in the singles mode and when closed it is in the doubles mode.

As when switch 101 is turned up for the doubles mode, relay 92 turns on because current is passing through the normally-closed contacts 94*a* of relay 92 so that relay 92 then activates relay 93. Then the timing cycle of relay 92 is complete. The relay 92 still has voltage but its contacts 92*a* are open. The only way that relay 93 can work again is if relay 94 is activated to allow the contacts which are normally closed to open for a second or so to allow relay 92 to be reset.

The adjusting knobs are set so that the time out for relay 91 is greater than relays 93 and 94. Relay 94 must be set for a greater time than relay 93. Relay 92 must be set for a greater time than relay 93 but less than the time set for relay 94 to drop the second target 31.

On reference to the wiring diagram FIG. 9, the relays are identified by the electromagnet coils of the relays which are numbered 91, 92, 93 and 94 respectively. The contacts for these relays are scattered throughout the drawing and indicated by lettered numbers and operational with the respective coil numberings. For instance, normally open contacts 91*a* and 91*b* are really associated with coil 91.

With all the relays set by their adjustable time delay turn knobs and placed in timed relationship with one another, a setting has been made depending upon the selected throw of the switch 101 for the release of either two targets or but one target to be dropped onto the flinger arm 29. With two targets, the second target is dropped in sequence with the first dropped target the first target having been moved along the flinger arm by the pusher arm 73. The flinger arm will then of course be loaded with two targets which will be heaved or flung simultaneously into the target area, accordingly means of selection for flinging of either two targets or but one target has been provided by this invention.

While various changes may be made in the detail construction and in the wire control system, it shall be understood that such changes shall be within the spirit and scope of the present invention as defined by the appended claims.

What is claimed is:

1. In combination, a trap shooting machine comprising base, laterally-shiftable and top vertically-adjustable housings assembled upon one another for relative movement therebetween, a releasable spring-based drive shaft extending vertically from the top housing, a target flinger arm extending laterally from the releasable drive shaft, a clay target feeder attachment mounted upon the top housing and overlying the flinger arm when in its loading position, said clay target feeder attachment having a column structure for containing clay targets stacked upon one another, automatic means carried upon the column structure for releasing the clay targets one at a time in response to the release of the flinger arm and upon the flinger arm being returned to its loading position and a selector control arrangement operable in connection with the automatic target releasing means to cause either one or two targets to be loaded upon the flinger arm prior to its release whereby the trap machine may be automatically and selectively loaded for single or double flinging of the targets by the flinger arm.

2. The combination as defined in claim 1 and said selector control arrangement including a pusher device to move a first loaded target along the flinger arm when the arm is to be loaded with two targets so as to make room for the second loaded target upon the flinger arm.

3. The combination as defined in claim 2 and said selector control arrangement further including adjustable time-delay relays to effect easy adjustment of the timing sequence for the release of the targets from the column structure and of the operation of the target pusher device by which the target is moved along the flinger arm.

* * * * *